US007701414B2

(12) United States Patent
Hur et al.

(10) Patent No.: US 7,701,414 B2
(45) **Date of Patent: *Apr. 20, 2010**

(54) PLASMA DISPLAY PANEL AND METHOD OF DRIVING THE SAME

(75) Inventors: Min Hur, Suwon-si (KR); Young-Do Choi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 1159 days.

This patent is subject to a terminal disclaimer.

(21) Appl. No.: 11/282,249

(22) Filed: Nov. 18, 2005

(65) Prior Publication Data

US 2006/0114179 A1 Jun. 1, 2006

(30) Foreign Application Priority Data

Nov. 30, 2004 (KR) ..... 10-2004-0098974

(51) Int. Cl.
*G09G 3/28* (2006.01)

(52) U.S. Cl. ..... 345/60; 345/63; 345/65; 345/61; 345/67

(58) Field of Classification Search ..... 345/50, 345/60–67, 71, 204, 206, 210, 211; 315/169.1–169.4; 313/506, 580–587
See application file for complete search history.

(56) References Cited

U.S. PATENT DOCUMENTS 5,175,473 A 12/1992 Kim
5,384,514 A 1/1995 Kim
5,744,909 A * 4/1998 Amano ..... 313/585
5,939,826 A 8/1999 Ohsawa et al.
5,939,828 A 8/1999 Matsuzaki et al.
6,097,357 A * 8/2000 Shinoda et al. ..... 345/63
6,380,678 B1 4/2002 Kim
6,414,435 B1 7/2002 Akiba
6,577,061 B2 * 6/2003 Sano et al. ..... 313/582
6,624,799 B1 * 9/2003 Kang et al. ..... 345/67

(Continued)

FOREIGN PATENT DOCUMENTS

CN 1380676 A 11/2002

(Continued)

OTHER PUBLICATIONS

Patent Abstracts of Japan, Publication No. 09-259768, dated Oct. 3, 1997, in the name of Hiroyuki Nakahara et al.

(Continued)

*Primary Examiner*—Prabodh M Dharia
(74) *Attorney, Agent, or Firm*—Christie, Parker & Hale, LLP

(57) ABSTRACT

A plasma display panel includes a first substrate and a second substrate facing each other with discharge cells therebetween, first and second display electrodes formed to extend along a first direction and between the first and second substrates to correspond to the discharge cells, the first and second display electrodes facing each other with a space therebetween to expand in a third direction from the first substrate to the second substrate; and first and second address electrodes formed to extend along a second direction intersecting the first direction, between the first and second substrates, and separated from each other in the third direction.

22 Claims, 9 Drawing Sheets

U.S. PATENT DOCUMENTS

| | | | | |
|---|---|---|---|---|
| 7,230,378 | B2 | 6/2007 | Su | |
| 7,274,144 | B2 * | 9/2007 | Choi et al. | 313/582 |
| 7,327,083 | B2 * | 2/2008 | Woo et al. | 313/587 |
| 2001/0050534 | A1 | 12/2001 | Amemiya et al. | |
| 2002/0027418 | A1 | 3/2002 | Huang et al. | |
| 2002/0135542 | A1 * | 9/2002 | Kim et al. | 345/50 |
| 2002/0145387 | A1 | 10/2002 | Akiba | |
| 2002/0180354 | A1 * | 12/2002 | Sano et al. | 313/582 |
| 2003/0034734 | A1 * | 2/2003 | Kim et al. | 313/582 |
| 2003/0080682 | A1 * | 5/2003 | Nagano | 313/582 |
| 2003/0146713 | A1 | 8/2003 | Nagao et al. | |
| 2003/0155863 | A1 * | 8/2003 | Lee | 313/587 |
| 2004/0104868 | A1 | 6/2004 | Ajiki et al. | |
| 2004/0135509 | A1 * | 7/2004 | Kwon et al. | 313/584 |
| 2004/0245929 | A1 | 12/2004 | Sakamoto | |
| 2004/0251831 | A1 | 12/2004 | Sung et al. | |
| 2005/0029939 | A1 | 2/2005 | Woo et al. | |
| 2005/0057443 | A1 * | 3/2005 | Whang et al. | 345/60 |
| 2005/0062422 | A1 * | 3/2005 | Sasaki et al. | 313/587 |
| 2005/0110409 | A1 | 5/2005 | Zeng et al. | |
| 2005/0264195 | A1 * | 12/2005 | Choi et al. | 313/582 |
| 2006/0043891 | A1 | 3/2006 | Tessier et al. | |
| 2006/0082307 | A1 * | 4/2006 | Choi et al. | 313/583 |
| 2006/0103304 | A1 * | 5/2006 | Hur et al. | 313/567 |
| 2006/0158113 | A1 * | 7/2006 | Hur et al. | 313/582 |
| 2006/0214584 | A1 * | 9/2006 | Hur et al. | 313/582 |
| 2007/0063643 | A1 * | 3/2007 | Cho et al. | 313/506 |

FOREIGN PATENT DOCUMENTS

| | | | |
|---|---|---|---|
| CN | 1399298 | A | 2/2003 |
| DE | 42 32 885 A 1 | | 4/1993 |
| EP | 1 146 539 | A2 | 10/2001 |
| EP | 1 460 669 | A1 | 9/2004 |
| JP | 02-284333 | | 11/1990 |
| JP | 03-155024 | | 7/1991 |
| JP | 05-225912 | | 9/1993 |
| JP | 7-37511 | | 2/1995 |
| JP | 07-111135 | | 4/1995 |
| JP | 07-320644 | | 12/1995 |
| JP | 9-129138 | | 5/1997 |
| JP | 9-259768 | | 10/1997 |
| JP | 11-213903 | | 8/1999 |
| JP | 2000-149772 | | 5/2000 |
| JP | 2000-215813 | | 8/2000 |
| JP | 2000-331615 | | 11/2000 |
| JP | 2001-222959 | | 8/2001 |
| JP | 2001-307639 | | 11/2001 |
| JP | 2002-203484 | | 7/2002 |
| JP | 2003-059411 | | 2/2003 |
| JP | 2003-086107 | | 3/2003 |
| JP | 2003-151449 | | 5/2003 |
| JP | 2003-197106 | | 7/2003 |
| JP | 2003-257321 | | 9/2003 |
| JP | 2003-338246 | | 11/2003 |
| JP | 2003-346665 | | 12/2003 |
| JP | 2004-235042 | | 8/2004 |
| JP | 2004-241379 | | 8/2004 |
| JP | 2004-273328 | | 9/2004 |
| JP | 2004247211 | | 9/2004 |
| KR | 10-2001-0026193 | | 4/2001 |
| KR | 2002029491 | A * | 4/2002 |
| KR | 2004-0097121 | | 11/2004 |
| KR | 10-2004-0108073 | | 12/2004 |
| WO | WO 03/032356 | A1 | 4/2003 |
| WO | WO 03/060864 | A1 | 7/2003 |

OTHER PUBLICATIONS

Patent Abstracts of Japan, Publication No. 07-037511, dated Feb. 7, 1995, in the name of Tetsuyoshi Tomioka et al.
Patent Abstracts of Japan, Publication No. 09-129138, dated May 16, 1997, in the name of Masaomi Ebe.
Patent Abstracts of Japan, Publication No. 11-213903, dated Aug. 6, 1999, in the name of Takashi Miyama et al.
Patent Abstracts of Japan, Publication No. 2000-149772, dated May 30, 2000, in the name of Yoshinobu Hirokado et al.
Korean Patent Abstracts, Publication No. 1020010026193 A, dated Apr. 6, 2001, in the name of Jin Won Hong.
Korean Patent Abstracts, Publication No. 1020040108073 A, dated Dec. 23, 2004, in the name of Yeong Jun Ahn et al.
European Search Report dated Jan. 10, 2006, for European application 05107084.5, indicating relevance of listed DE, EP and U.S. 5,384,514 references in this IDS.
U.S. Office action dated Sep. 22, 2008, for related U.S. Appl. No. 11/197,628, indicating relevance of listed U.S. references in this IDS.
Patent Abstracts of Japan, Publication No. 02-284333, dated Nov. 21, 1990, in the name of Naoatsu Higuchi.
Patent Abstracts of Japan, Publication No. 03-155024, dated Jul. 3, 1991, in the name of Motoo Sugawara.
Patent Abstracts of Japan, Publication No. 07-320644, dated Dec. 8, 1995, in the name of Taichi Shino et al.
Patent Abstracts of Japan, Publication No. 2003-197106, dated Jul. 11, 2003, in the name of Susumu Sakamoto.
Patent Abstracts of Japan, Publication No. 2003-257321, dated Sep. 12, 2003, in the name of Hirokazu Hashikawa.
Patent Abstracts of Japan, Publication No. 2003-338246, dated Nov. 28, 2003, in the name of Yoshio Suzuki et al.
Patent Abstracts of Japan, Publication No. 2003-346665, dated Dec. 5, 2003, in the name of Masaki Aoki et al.
Patent Abstracts of Japan, Publication No. 2004-235042, dated Aug. 19, 2004, in the name of Susumu Sakamoto et al.
Patent Abstracts of Japan, Publication No. 2004-241379, dated Aug. 25, 2004, in the name of Kazuki Shigeta et al.
Patent Abstracts of Japan, Publication No. 2004-247211, dated Sep. 2, 2004, in the name of Shinsuke Mori et al.
Patent Abstracts of Japan, Publication No. 2004-273328, dated Sep. 30, 2004, in the name of Shinsuke Mori.
Patent Abstract of Japan for Publication No. 2000-331615; Date of publication of application Nov. 30, 2000, in the name of Hirakawa Hitoshi et al.
Patent Abstract of Japan for Publication No. 2003-151449; Date of publication of application May 23, 2003 in the name of Inoue Kazunori et al.
European Search Report, dated Apr. 21, 2006, for Application No. 05111198.7, in the name of Samsung SDI Co., Ltd.
Patent Abstracts of Japan, Publication No. 05-225912, dated Sep. 3, 1993, in the name of Dae-Il Kim.

* cited by examiner

PLASMA DISPLAY PANEL AND METHOD OF DRIVING THE SAME

CROSS-REFERENCE TO RELATED APPLICATION

This application claims priority to and the benefit of Korean Patent Application No. 10-2004-0098974, filed in the Korean Intellectual Property Office on Nov. 30, 2004, the entire content of which is incorporated herein by reference.

BACKGROUND OF THE INVENTION

1. Field of the Invention

The present invention relates to a plasma display panel and a method of driving the same and, more specifically, to a plasma display panel which is capable of decreasing a discharge firing voltage and reducing a reset period and an addressing period to improve a gray-scale representation, and a method of driving the same.

2. Description of Related Art

One example of a typical plasma display panel (hereinafter, referred to as PDP) is a 3-electrode surface discharge type PDP. The 3-electrode surface discharge type PDP includes a first substrate having a sustain electrode coplanar with a scan electrode extending in a first (or horizontal) direction; a second substrate separated from the first substrate by a certain distance, and having an address electrode extending in a second (or vertical) direction; and a discharge gas sealed between the first and second substrates. A discharge of the address electrode and the scan electrode associated with a cell of the PDP and controlled independently determines whether the cell of the PDP is discharged or not, and a sustain discharge that displays an image is then performed by the sustain electrode and the scan electrode arranged on the first substrate.

The PDP uses a glow discharge to generate visible light, and undergoes several processes until the visible light reaches human eyes after the glow discharge is generated. In other words, when the glow discharge is generated, electrons and gases are collided with each other to generate an excited gas, which generates ultraviolet (UV) light, and the UV light is collided with phosphors in a discharge cell to thus generate visible light. Further, the visible light is then transmitted through a front transparent substrate in order to reach the human eyes. Through the above-mentioned processes, an input power applied to the sustain electrode and the scan electrode is significantly lost.

In more detail, a voltage higher than the discharge firing voltage is applied between two electrodes (e.g., the sustain and scan electrodes) to generate the glow discharge. Specifically, to initiate the discharge, a significantly high voltage is needed. Once the discharge occurs, a voltage distribution between positive and negative electrodes is in a distorted manner due to a space charge effect produced in a dielectric layer around a cathode and an anode. In other words, between the two electrodes, there are provided a cathode sheath region around the cathode in which most voltage applied to the two electrodes is consumed for discharge, an anode sheath region around the anode in which a part of the voltage is consumed, and a positive column region formed between these two regions in which minimal voltage is consumed. An electron heating efficiency in the cathode sheath region depends on a secondary electron coefficient of a Magnesium Oxide (MgO) protective layer formed on the surface of the dielectric layer, and most of the input energy in the positive column region is consumed in electron heating.

A vacuum ultraviolet light (or vacuum ultraviolet) collided with the phosphors to emit visible light is generated when a Xenon (Xe) gas in an excitation state transits to a ground state, and Xe is excited due to collision of the Xe gas and the electrons. Therefore, in order to increase the ratio of generating visible light with respect to the input energy (i.e., luminescence efficiency), an electron heating efficiency should be increased to enhance collision between the Xe gas and the electrons.

In the cathode sheath region, most of the input energy is consumed but the electron heating efficiency is low, while in the positive column region, less of the input energy is consumed and the electron heating efficiency is very high. Therefore, high luminescence efficiency can be achieved with the positive column region (discharge gap).

In addition, with respect to the ratio of consumed electrons to total electrons in accordance with a change in the ratio of a gas density n to an electric field E applied between the discharge gaps (positive column region), it is known that an electron consumption ratio at the same ratio (E/n) increases in the order of Xenon excitation ($Xe^*$), Xenon ion ($Xe^+$), Neon excitation ($Ne^*$), and Neon ion ($Ne^+$). In addition, with the same ratio of E/n, as a partial pressure of Xe increases, electron energy is reduced. In other words, as the electron energy is reduced, the partial pressure of Xe is increased, and in addition, as the partial pressure of Xe is increased, a ratio of electrons consumed by excitation of Xe relative to other portions among the electrons consumed in the above-mentioned Xenon excitation ($Xe^*$), Xenon ion ($Xe^+$), Neon excitation ($Ne^*$), and Neon ion ($Ne^+$) is increased, thereby improving luminescence efficiency.

As described above, increase of the positive column region causes the electron heating efficiency to be increased. Further, the increase of the partial pressure of Xe causes a ratio of heated electrons consumed in the Xe excitation ($Xe^*$) among the electrons to be increased to thereby further increase electron heating efficiency so that the luminescence efficiency is further improved.

However, both the increase of the positive column region and the increase of the partial pressure of Xe increase a discharge firing voltage and has a problem in that the manufacturing costs of a PDP are increased.

Therefore, in implementing the increase of the positive column region and the increase of the partial pressure of Xe to increase the luminescence efficiency, there is a need to lower a discharge firing voltage.

Also, it is known that a discharge firing voltage required for a surface discharge structure is lower than a discharge firing voltage required for an opposed discharge structure, when a distance between discharge gap and the Xe pressure for each of the structures is identical.

SUMMARY OF THE INVENTION

Accordingly, an embodiment of the present invention provides a plasma display panel which is capable of decreasing a discharge firing voltage and reducing a reset period and an addressing period to improve a gray-scale representation and a method of driving the same.

One embodiment of the present invention provides a plasma display panel including a first substrate and a second substrate arranged to face each other with a predetermined space therebetween and having a plurality of discharge cells defined in the space between the first and second substrates; a plurality of phosphor layers formed inside the respective discharge cells; first and second display electrodes formed to extend along a first direction and between the first and second substrates to correspond to the respective discharge cells, the respective first and second display electrodes facing each other with a space therebetween to expand in a third direction from the first substrate to the second substrate; and first and second address electrodes formed to extend along a second direction intersecting the first direction, between the first and second substrates, and separated from each other in the third direction.

The plasma display panel may further include: a first barrier rib layer adjacent to the first substrate, and adapted to define a plurality of first discharge spaces; and a second barrier rib layer adjacent to the second substrate, and adapted to define a plurality of second discharge spaces facing the respective first discharge spaces defined by the first barrier rib layer. Opposing pairs of discharge spaces may define the respective discharge cell. In one embodiment, a discharge space formed by the second barrier rib layer is formed with a larger volume than a discharge space formed by the first barrier rib layer.

The first and second display electrodes and the first and second address electrodes may be arranged between the first and second barrier rib layers.

In addition, the first barrier rib layer may include a first barrier rib member formed to extend in the first direction, and the second barrier rib layer may include a second barrier rib member formed to extend in the first direction. Further, the first barrier rib layer may include a third barrier rib member formed to intersect the first barrier rib member, and the second barrier rib layer may include a fourth barrier rib member formed to intersect the second barrier rib member.

The first and second address electrodes may be formed along the first barrier rib member between the first barrier rib member of the first barrier rib layer and the second barrier rib member of the second barrier rib layer. In addition, the first and second address electrodes may be arranged to pass through a boundary of a pair of adjacent discharge cells in the first direction.

The first address electrode may be arranged closer to the first substrate than to the second substrate and the second address electrode may be arranged closer to the second substrate than to the first substrate, and the first and second display electrodes may be interposed between the first and second address electrodes.

The first and second address electrodes may include first and second protrusion portions alternately protruded toward the center of the respective discharge cells successively arranged along the second direction.

The first and second address electrodes, corresponding to a pair of the discharge cells arranged to be adjacent along the second direction, may be arranged together on a same side of the pair of the discharge cells. Alternatively, the first and second address electrodes, corresponding to a pair of the discharge cells arranged to be adjacent along the second direction, may be arranged on different sides of the pair of the discharge cells, respectively.

In one embodiment of the present invention, the first and second address electrodes are each made of a metal electrode, to thus have a good electrical conductivity.

Each of the first and second display electrodes may include: an expanded portion corresponding to one of the discharge cells and extending in the third direction; and a narrow portion corresponding to boundaries of the discharge cells successively arranged along the first direction and having a smaller width than the expanded portion. The expanded portions of the first and second display electrodes may be symmetric with respect to a centerline of the narrow portion extending in first direction.

In one embodiment of the present invention, the first and second display electrodes are each made of a metal electrode, to thus have a good electrical conductivity.

The first and second display electrodes and the first and second address electrodes may form an insulating arrangement having dielectric layers on their outer surfaces, respectively, and each dielectric layer may include a protective layer on its outer surface.

In addition, a method of driving a plasma display panel according to an embodiment of the present invention arranged as described above includes applying a scan pulse to a corresponding one of the second display electrodes shared by first and second discharge cells of the discharge cells adjacent along the second direction, during an addressing period; and addressing the first and second discharge cells to which the scan pulse is applied.

In the addressing of the first and second discharge cells, the first and second discharge cells may be addressed substantially simultaneously.

In addition, in the addressing of the first and second discharge cells, the first discharge cell may be addressed by the first address electrode, and/or the second discharge cell is addressed by the second address electrode.

DETAILED DESCRIPTION

Figure 1:
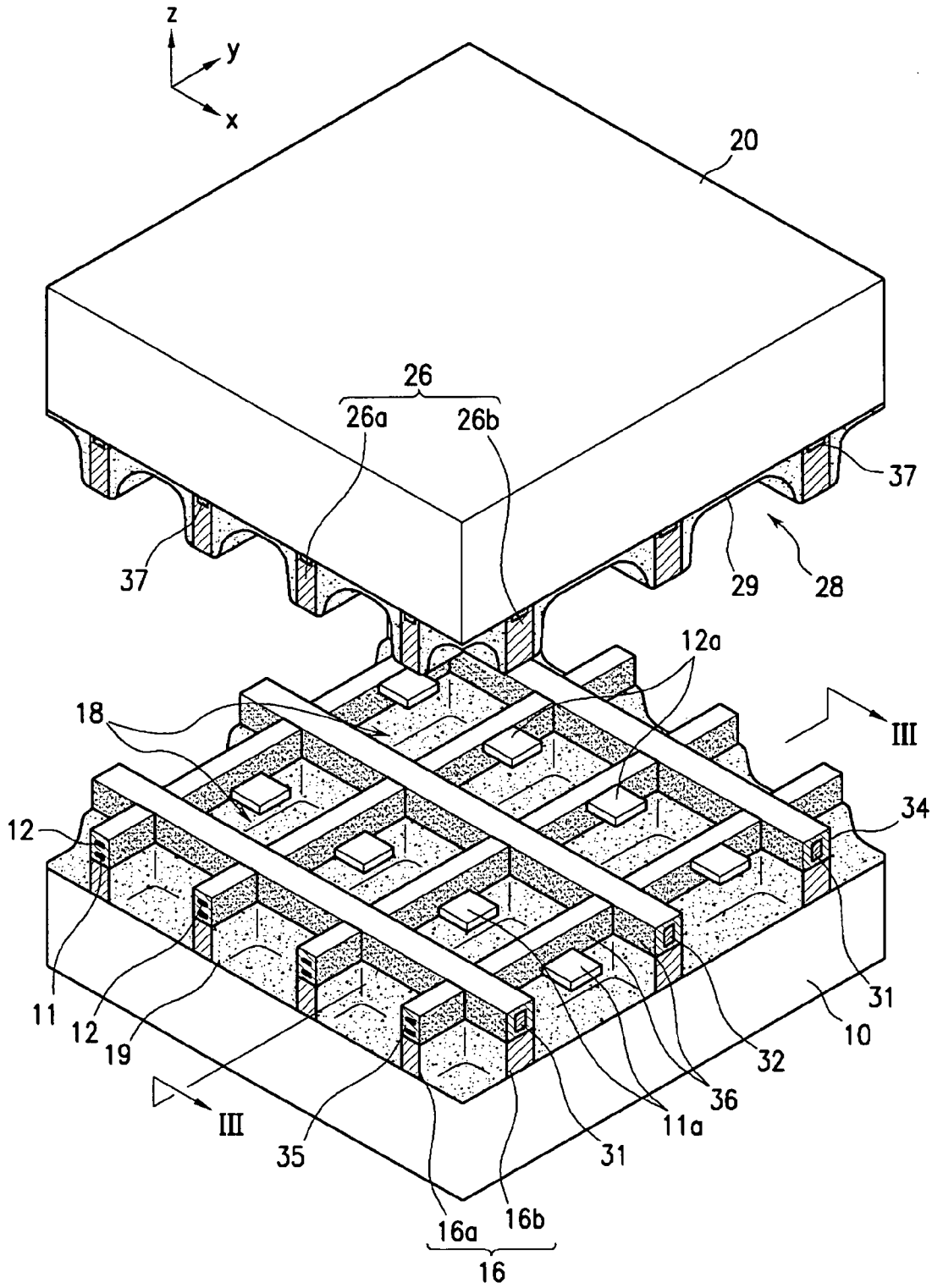
FIG. 1 is a partial exploded perspective view showing a plasma display panel according to a first embodiment of the present invention.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification, as they are not essential to a complete understanding of the invention. Like reference numerals designate like elements.

Figure 2:
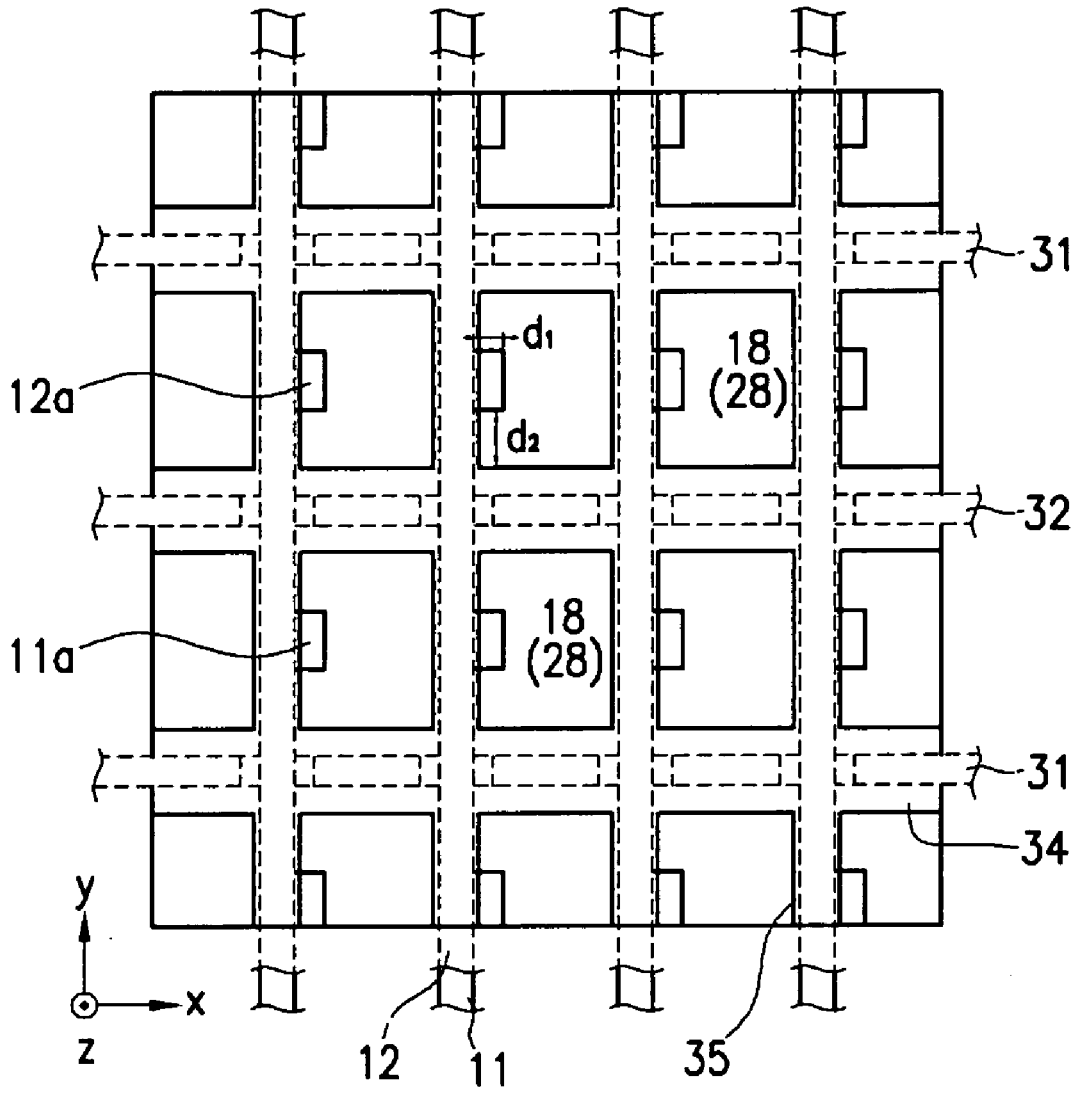
FIG. 2 is a partial plan view schematically showing an arrangement of electrodes and discharge cells in a plasma display panel according to the first embodiment of the present invention.
Figure 3:
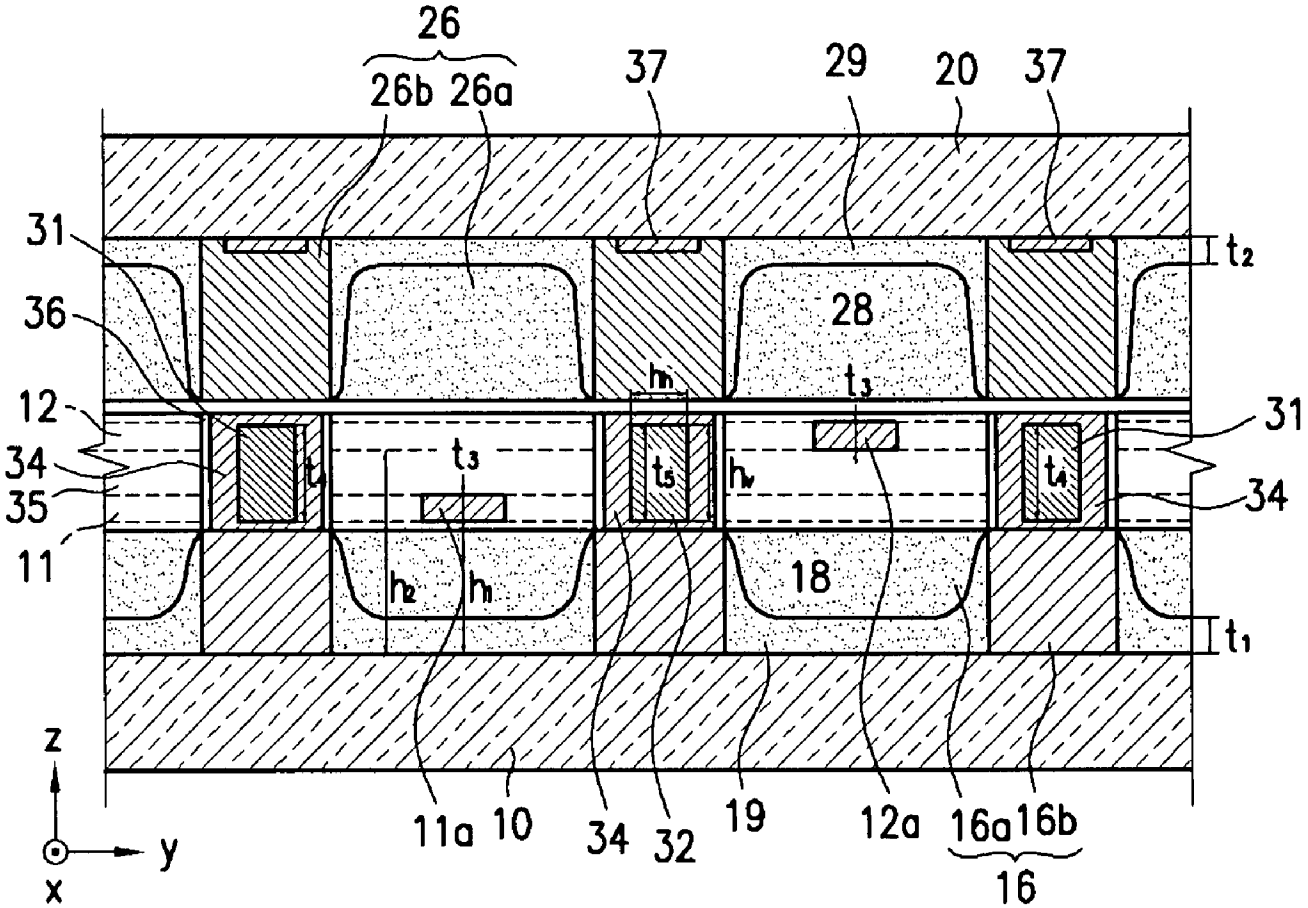
FIG. 3 is a partial cross-sectional view taken along a cut-line III-III of the plasma display panel shown in FIG. 1.
Figure 4:
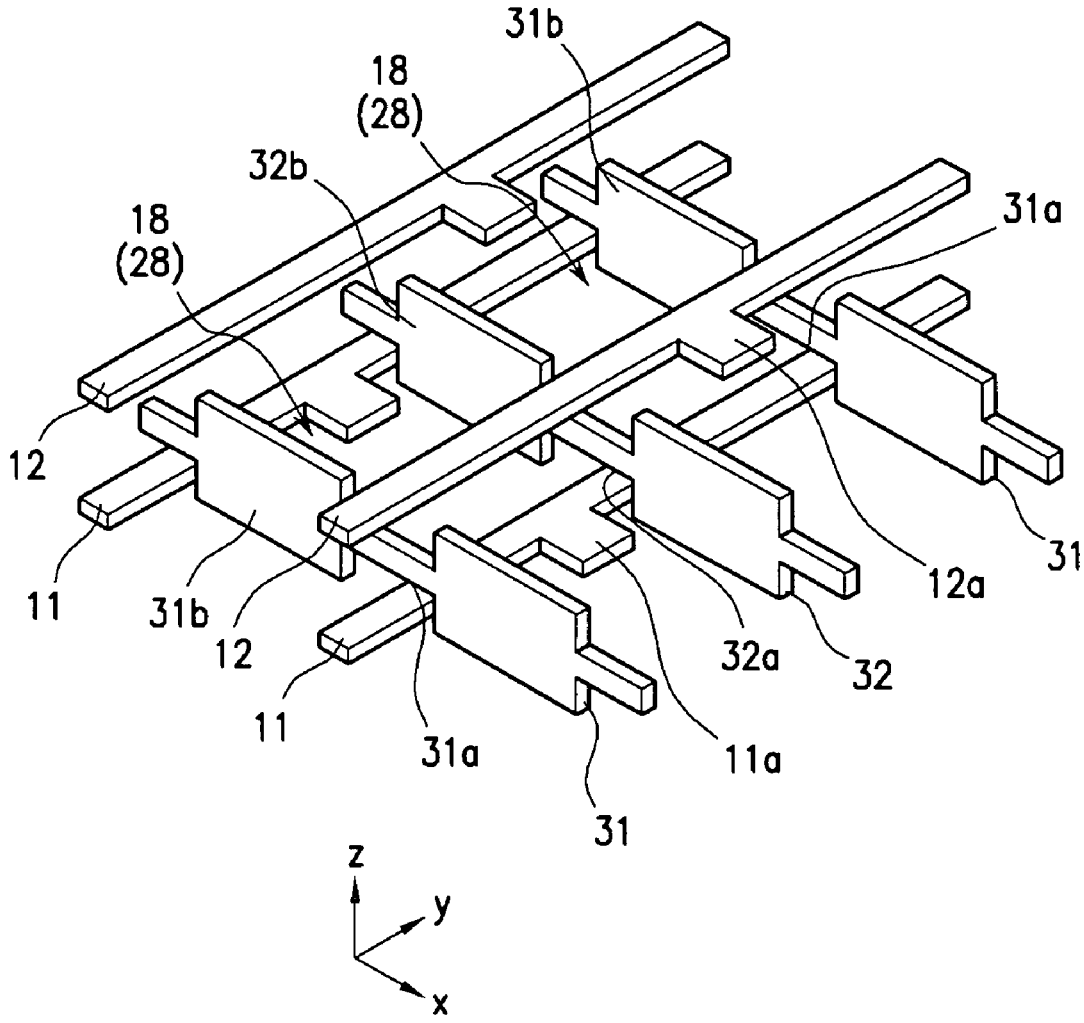
FIG. 4 is a partial perspective view schematically showing an arrangement of an electrode in the plasma display panel according to the first embodiment of the present invention.

FIG. 1 is a partial exploded perspective view showing a plasma display panel according to a first embodiment of the present invention; FIG. 2 is a partial plan view schematically showing an arrangement of electrodes and discharge cells in a plasma display panel according to the first embodiment of the present invention; FIG. 3 is a partial cross-sectional view taken along a cut-line III-III of the plasma display panel shown in FIG. 1; and FIG. 4 is a partial perspective view schematically showing an arrangement of an electrode in the plasma display panel according to the first embodiment of the present invention.

With reference to FIGS. 1 to 4, a PDP of the present embodiment includes a first substrate 10 (hereinafter, referred to as a rear substrate) and a second substrate 20 (hereinafter, referred to as a front substrate) arranged to face each other with a predetermined gap therebetween, and discharge cells 18, 28 formed by a plurality of discharge spaces defined using a first barrier rib layer 16 (hereinafter, referred to as a rear plate barrier rib) and a second barrier rib layer 26 (hereinafter, referred to as a front plate barrier rib) between the rear substrate 10 and the front substrate 20. In the discharge cells 18, 28, phosphor layers 19 and 29 that absorb vacuum ultraviolet to emit visible light are provided, and a discharge gas (e.g., a mixed gas including Xe and Ne) is charged such that the vacuum ultraviolet can be generated with a plasma discharge.

The rear plate barrier rib 16 and the front plate barrier rib 26 are formed and arranged in a corresponding arrangement between the rear substrate 10 and the front substrate 20. The rear plate barrier rib 16 is adjacent to the rear substrate 10 and is protruded toward the front substrate 20, and the front plate barrier rib 26 is adjacent to the front substrate 20 and is protruded toward the rear substrate 10 corresponding to the rear plate barrier rib 16.

The rear plate barrier rib 16 forms one side of a discharge cell 18 by defining a plurality of discharge spaces adjacent to the rear substrate 10, and the front plate barrier rib 26 forms one side of a discharge cell 28 by defining a plurality of discharge spaces adjacent to the front substrate 20. The one side of the discharge cell 18 faces the one side of the discharge cell 28. As such, with the discharge spaces facing each other on both sides (e.g., in a z-axis direction), one combined discharge cell 18, 28 is substantially formed. Unless particularly stated otherwise with respect to the discharge cells 18 and the discharge cells 28 in the present invention, each of the discharge cells 18, 28 refers to a discharge space formed into the one combined discharge cell 18, 28 by the discharge spaces on both sides. Also, a discharge space formed by the rear plate barrier rib 16, i.e., a discharge space where one side of a discharge cell 18 is formed, is smaller in volume than a discharge space formed by the front plate barrier rib 26, i.e., a discharge space where one side of a discharge cell 28 is formed, in order to improve transmittance to the front substrate 20 of the visible light generated in the discharge cells 18, 28.

With other suitable rear plate barrier ribs and front plate barrier ribs (e.g., the rear plate barrier rib 16 and the front plate barrier rib 26), discharge cells (e.g., the discharge cells 18, 28) can be formed in various shapes such as a quadrangle shape or a hexagon shape. Thus, although the shape of the discharge cells 18, 28 of the present embodiment is illustrated as being rectangle, the present invention is not thereby limited.

With reference to the present embodiment, the rear plate barrier rib 16 is shown to be formed on the rear substrate 10, and according to the present embodiment, the rear plate barrier rib 16 includes a first barrier rib member 16*a* arranged to extend in a first direction (e.g., in a y-axis direction), and a third barrier rib member 16*b* formed on the rear substrate 10 to intersect the first barrier rib member 16*a* to define a discharge cell 18 serving as an independent discharge space of the discharge spaces.

The front plate barrier rib 26 is formed on the front substrate 20, which includes a second barrier rib member 26*a* protruded toward the rear substrate 10 in a shape corresponding to the first barrier rib member 16*a*, and a fourth barrier rib member 26*b* protruded toward the rear substrate 10 in a shape corresponding to the third barrier rib member 16*b*. Therefore, the second barrier rib member 26*a* formed to extend in the first direction intersects the fourth barrier rib member 26*b* of the front plate barrier rib 26 formed to extend in a second direction (e.g., in an intersect direction or in an x-axis direction). As such, the second barrier rib member 26*a* and the fourth barrier rib member 26*b* form a discharge cell 28 on the front substrate 20 corresponding to the discharge cell 18 on the rear substrate 10.

The phosphor layers 19 and 29 are formed in the discharge cells 18, 28 defined by the rear plate barrier rib 16 and the front plate barrier rib 26, respectively. In other words, the phosphor layers 19 and 29 include a first phosphor layer 19 that is formed in the one side discharge cell 18 on the rear substrate 10 and a second phosphor layer 29 that is formed in the one side discharge cell 28, corresponding to the discharge cell 18, on the front substrate 20, so that the phosphor layers 19 and 29 generate visible light at both sides of one combined discharge cell 18, 28 to thus improve luminescence efficiency.

Since the discharge cell 18 formed by the rear plate barrier rib 16 and the discharge cell 28 formed by the front plate barrier rib 26 opposing thereto are substantially one discharge cell 18, 28, the first phosphor layer 19 and the second phosphor layer 29 respectively formed therein are in one embodiment of the invention made of phosphors that generate the same color visible light due to a collision of vacuum ultraviolet generated by gas discharge.

At this time, the first phosphor layer 19 is formed on each inner surface of the first barrier rib member 16*a* and the third barrier rib member 16*b*, and the surface of the rear substrate 10 in the discharge cell 18, while the second phosphor layer 29 is formed on each inner surface of the second barrier rib member 26*a* and the fourth barrier rib member 26*b* and the surface of the rear substrate 10 in the discharge cell 28.

Further, the first phosphor layer 19 formed in the discharge cell 18 of the rear substrate 10 may be formed by forming a dielectric layer (not shown) on the rear substrate 10, forming the rear plate barrier rib 16, and then depositing a phosphor material on the dielectric layer. Alternatively, the first phosphor layer 19 may be formed by not forming the dielectric layer on the rear substrate 10, forming the rear plate barrier rib 16 on the rear substrate 10, and then depositing the phosphor material.

In a similar manner, the second phosphor layer 29 formed in the discharge cell 28 of the front substrate 20 may be formed by forming a dielectric layer on the front substrate 20, forming the front plate barrier rib 26, and then depositing a phosphor material on the dielectric layer. Alternatively, the second phosphor layer 29 may be formed by not forming the dielectric layer on the front substrate 20, forming the front plate barrier rib 26 on the front substrate 20, and then depositing the phosphor material.

In another embodiment, the rear substrate 10 and the front substrate 20 are respectively etched corresponding to the shapes of discharge cells 18, 28, and then a phosphor material is deposited thereon to thus form the first phosphor layer 19 and the second phosphor layer 29, respectively. In this embodiment, the rear plate barrier rib 16 and the rear plate 10 are made of the same material, and the front plate barrier rib 26 and the front substrate 20 are made of the same material.

In the PDP of the foregoing description, after sustain discharge, the first phosphor layer 19 absorbs the vacuum ultraviolet in the discharge cell 18, and the second phosphor layer 29 absorbs the vacuum ultraviolet in the discharge cell 28, and generates visible light toward the front substrate 20. In addition, the second phosphor layer 29 allows the visible light to be transmitted, so that in one embodiment of the present invention a thickness $t_1$ of the first phosphor layer 19 formed on the rear substrate 10 is thicker than a thickness $t_2$ of the second phosphor layer 29 formed on the front substrate 20, i.e., $t_1>t_2$. With this, the loss of the vacuum ultraviolet is minimized and thus the luminescence efficiency can be enhanced.

In order to display images by generating the vacuum ultraviolet to be collided on the first phosphor layer 19 and the second phosphor layer 29 as described above through a plasma discharge, a first address electrode 11 and a second address electrode 12, and a first display electrode 31 (hereinafter, referred to as a sustain electrode) and a second display electrode 32 (hereinafter, referred to as a scan electrode) that correspond to the respective discharge cells 18, 28 are included between the rear substrate 10 and the front substrate 20.

The sustain electrode 31 and the scan electrode 32 are formed to extend with each other, and correspond to the respective discharge cells 18, 28. The sustain electrode 31 and the scan electrode 32 are alternately arranged while each is being shared by adjacent discharge cells 18, 28 in a direction parallel to the first and second address electrodes 11 and 12. In other words, the sustain electrode 31 is shared by one set of adjacent discharge cells 18, 28 along an extended direction (e.g., in a y-axis direction) of the first and second address electrodes 11 and 12 using one discharge cell 18, 28 as a reference, and the scan electrode 32 is shared by another set of adjacent discharge cell 18, 28 along the y-axis direction. Therefore, each of the sustain electrode 31 and the scan electrode 32 is involved in the sustain discharge of at least two adjacent discharge cells 18, 28.

The first address electrode 11 and the second address electrode 12 are formed to extend in a direction crossing the sustain electrode 31 and the scan electrode 32, separated from the rear substrate 10 (or the front substrate 20) in a direction perpendicular to the rear substrate 10, and are thus involved in the addressing of the adjacent discharge cells 18, 28 along the y-axis direction of FIGS. 1 through 4. In other words, with reference to one discharge cell 18, 28, while a pair of the first and second address electrodes 11 and 12 are arranged, the first address electrode 11 is involved in the addressing of one discharge cell 18, 28, and the second address electrode 12 is involved in the addressing of another discharge cell 18, 28 adjacent to the one discharge cells 18, 28 addressed by the first address electrode 11. In other words, the first address electrode 11 and the second address electrode 12 are involved in alternately addressing the discharge cells 18, 28 that are successively arranged in the y-axis direction.

The first and second address electrodes 11 and 12 are formed to extend in one direction (e.g., in a y-axis direction) between the rear plate barrier rib 16 and the front plate barrier rib 26, and are arranged in parallel to each other. Parallel arrangement of the first and second address electrodes 11 and 12 can be formed in various manners.

In one embodiment as an example, the first and second address electrodes 11 and 12 can be included on the same side of the discharge cells 18, 28, in which case, the first address electrode 11 is formed closer to the rear substrate 10 and the second address electrode 12 is formed closer to the front substrate 20. In other words, each of the first address electrode 11 and the second address electrode 12 is formed in positions separated from the rear substrate 10 by different distances $h_1$ and $h_2$, and do not interfere with each other in terms of arrangement. Therefore, the first address electrode 11 and the second address electrode 12 are arranged such that the sustain electrode 31 and the scan electrode 32 are interposed between the first address electrode 11 and the second address electrode 12 (see FIG. 4), and are also arranged such that the first address electrode 11 is arranged closer to the rear substrate 10, and the second address electrode 12 is arranged closer to the front substrate 20.

The first and second address electrodes 11 and 12 correspond to the first barrier rib member 16*a* on the rear substrate 10 and the second barrier rib member 26*a* on the front substrate 20, and are formed therebetween to extend along the direction parallel thereto (e.g., in a y-axis direction). In addition, the first and second address electrodes 11 and 12 correspond to the first barrier rib member 16*a* and the second barrier rib member 26*a*, respectively, and are arranged in parallel to each other while forming a gap corresponding to the discharge cells 18, 28 in the x-axis direction.

The first and second address electrodes 11 and 12 are arranged in parallel on one side of the discharge cells 18, 28, to be addressed so that the first and second address electrodes 11 and 12 include protrusion portions 11*a* and 12*a*, respectively, protruded toward the center of the respective discharge cells 18, 28, to be addressed such that one discharge cell 18, 28 can be addressed with an address pulse applied to the first and second address electrodes 11 and 12 and a scan pulse applied to the respective scan electrode 32. While there are various embodiments in which one discharge cell 18, 28 can be addressed while being arranged on one side of a plurality of successive discharge cells 18, 28, the protrusion portions 11*a* and 12*a* herein are illustrated such that they are protruded into the discharge cell 18, 28 and arranged to be adjacent to the scan electrode 32.

While the first and second address electrodes 11 and 12 are arranged on one side of one discharge cell 18, 28, a protrusion portion 11*a* of the first address electrode 11 is formed corresponding to a successively arranged discharge cell 18, 28 of an odd-numbered group, and a protrusion portion 12*a* of the second address electrode 12 is formed corresponding to a successively arranged discharge cell 18, 28 of an even-numbered group. Alternatively, a protrusion portion 11*a* may be formed corresponding a successively arranged discharge cell 18, 28 of an even-numbered group, and a protrusion 12*a* may be formed corresponding to a successively arranged discharge cell 18, 28 of an odd-numbered group. The first and second address electrodes 11 and 12 interact with a respective scan electrode 32 for an addressing operation, so that the protrusion portion 11*a* of the first address electrode 11 is protruded centering on one side of a discharge cell 18, 28 that shares the respective scan electrode 32 with another discharge cell 18, 28, while the protrusion portion 12*a* of the second address electrode 12 is protruded centering on one side of the another discharge cell 18, 28 that shares the same respective scan electrode 32. Specifically, the protrusion portions 11*a* and 12*a* are alternately arranged on the successively arranged discharge cells 18, 28.

In addition, since the first address electrode 11 is arranged close to the rear substrate 10, the protrusion portion 11*a* serves as an addressing unit in a portion of the discharge cell 18 facing the rear substrate 10. Further, since the second address electrode 12 is arranged close to the front substrate 20, the protrusion portion 12*a* serves as an addressing unit in a portion of the discharge cell 28 facing the front substrate 20.

The first and second address electrodes 11 and 12 are arranged between non-discharge regions, i.e., the first barrier rib member 16*a* and the second barrier rib member 26*a*, so that they do not block visible light generated at the discharge cells 18, 28 and thus may be made of an opaque material and/or a metal electrode having a good electric conductivity. Each of the protrusion portions 11*a* and 12*a* is protruded centering on the discharge cells 18, 28 and thus may be made of a transparent electrode, or may be made of the same material as the first and second address electrodes 11 and 12, respectively.

In addition, the first and second address electrodes 11 and 12 include the protrusion portions 11*a* and 12*a* respectively protruded toward the center of the respective discharge cell 18, 28, and the protrusion portions 11*a* and 12*a* are located at both sides of the respective scan electrode 32 shared by two discharge cells 18, 28. Therefore, each protrusion portion 11*a*, 12*a* of the first and second address electrodes 11 and 12 is for applying an address pulse applied into the discharge cell 18, 28, and when the scan pulse is applied to the respective scan electrode 32 and the address pulse is applied to the first and second address electrodes 11 and 12, addressing is implemented twice in one scan. In other words, two rows of discharge cells 18, 28 can be addressed at the same time by one scan. In addition, the scan electrode 32 and the discharge gap can be formed with a short gap in the discharge cells 18, 28, so that the protrusion portions 11*a* and 12*a* can reduce an address discharge voltage.

Further, the sustain electrode 31 and the scan electrode 32 are formed between the rear plate barrier rib 16 and the front plate barrier rib 26 constituting the discharge cells 18, 28 at both sides, and are formed to extend along the direction that intersects the first and second address electrodes 11 and 12 (e.g., in the x-axis direction) while being electrically insulated. The sustain electrode 31 is arranged at one side of a respective discharge cell 18, 28, and the scan electrode 32 is arranged in parallel to the sustain electrode 31 at another side of the respective discharge cell 18, 28. The sustain electrode 31 and the scan electrode 32 are alternately arranged such that they are shared with the adjacent discharge cells 18, 28 that are successively arranged. In other words, with reference to two discharge cells 18, 28, the scan electrode 32 is arranged between the third and fourth barrier rib members 16*b* and 26*b* that define the two discharge cells 18, 28 in the middle of the two discharge cells 18, 28, and the sustain electrode 31 is arranged on either side of the two discharge cells 18, 28. It will be readily appreciated that the sustain electrode 31 is also arranged between the third and fourth barrier rib members 16*b* and 26*b* that define two other adjacent discharge cells 18, 28. Therefore, when the address pulse is applied to the first and second address electrodes 11 and 12 and the scan pulse is applied to the scan electrode 32, two addressing operations for selecting the two adjacent discharge cells 18, 28 are implemented in one scan, and thus an addressing period is reduced. In addition, when the reset pulse is applied to the scan electrode 32, two discharge cells 18, 28 sharing the scan electrode 32 are reset and a reset period is reduced. As such, the reset period and the addressing period are reduced, so that a sustain period can become longer, which increases the number of the sustain pulses and improves a gray scale representation.

As shown in FIG. 4, the sustain electrode 31 and the scan electrode 32 are formed and arranged to implement two addressing operations of two adjacent discharge cells 18, 28 in the y-axis direction in one scan. The protrusion portion 11*a* of the first address electrode 11 is arranged on one side of one of the two adjacent discharge cells 18, 28 that share the scan electrode 32, and the protrusion portion 12*a* of the second address electrode 12 is arranged on one side of another one of the two adjacent discharge cells 18, 28 that share the scan electrode 32.

The sustain electrode 31 and the scan electrode 32 are formed to extend between the third barrier rib member 16*b* and the fourth barrier rib member 26*b* along the direction parallel thereto (e.g., in the x-axis direction), and alternately arranged in the successively arranged discharge cell 18, 28. According to the present invention, the sustain electrode 31 and the scan electrode 32 are arranged between the third barrier rib member 16*b* and the fourth barrier rib member 26*b*, so that they can define the adjacent discharge cells 18, 28 in the longitudinal direction (e.g., in the y-axis direction) of the first and second address electrodes 11 and 20, and are also shared by the adjacent discharge cells 18, 28 in this direction, thus they provide for an sustain discharge operation of two discharge cells 18, 28.

The scan electrode 32 is involved in an addressing operation during an addressing period along with the first and second address electrodes 11 and 12, and thus serves to select the discharge cells 18, 28 to turn on. Further, the sustain electrode 31 and the scan electrode 32 are involved in a sustain discharge operation during a sustain period and serve to display a screen. In other words, the sustain pulse is applied to both the sustain electrode 31 and the scan electrode 32 during a sustain period, and the scan pulse is applied to the scan electrode 32 (and not the sustain electrodes) during the scan period. However, each electrode may play a different role that varies according to an applied signal voltage, so that the present invention is not limited hereto.

The sustain electrode 31 and the scan electrode 32 are arranged between both substrates 10 and 20 to substantially define one discharge cell 18, 28 along with the first and second address electrodes 11 and 12, to thus form an opposed discharge structure. As described in more detail below, the present invention can reduce a discharge firing voltage for the sustain discharge of this opposed discharge structure.

To this end, referring to FIG. 4, in order to induce the opposed discharge in a larger area, the sustain electrode 31 and the scan electrode 32 include expanded portions 31*b* and 32*b* that are expanded in a direction (e.g., in a z-axis direction) perpendicular to the rear substrate 10 and the front substrate 20 in a portion corresponding to each discharge cell 18, 28, respectively. The expanded portions 31*b* and 32*b* are formed in an expanded arrangement on the sides of the rear substrate 10 and the front substrate 20, and are symmetric in the direction (e.g., in the z-axis direction) perpendicular to the rear substrate 10 and the front substrate 20 with respect to each longitudinal axis direction of the sustain electrode 31 and the scan electrode 32 (the x-axis direction). Each of the expanded portions 31*b* and 32*b* includes an opposed surface that faces the discharge cell 18, 28, and is arranged to face each other with the discharge cell 18, 28 therebetween.

In addition, referring more specifically to FIG. 3, each of the expanded portions 31*b* and 32*b* has an arrangement in which a length of the vertical direction $h_v$ is larger than a length of the horizontal direction $h_h$ in the cross section of the sustain electrode 31 and the scan electrode 32 taken along the perpendicular direction to the rear substrate 10 and the front substrate 20. The opposed discharge widely formed in the expanded portions 31*b* and 32*b* generate a strong vacuum ultraviolet, and the strong ultraviolet increases an amount of light generated due to collision with the phosphor layers 19 and 29 across a wide area in the discharge cells 18, 28.

As shown in FIG. 4, the sustain electrode 31 and the scan electrode 32 are formed to extend along the direction crossing the first and second address electrodes 11 and 12, and can be alternately and smoothly arranged without interference with the first and second address electrodes 11 and 12 formed in a straight line and respectively including the protrusion portions 31*b* and 32*b*, as the expanded portions 31*b* and 32*b* formed in the direction perpendicular to the rear substrate 10 and the front substrate 20 are included corresponding to the respective discharge cells 18, 28.

Further, the sustain electrode 31 and the scan electrode 32 correspond to boundaries of the discharge cells successively arranged in the x-axis direction of the drawings, and have narrow portions 31*a* and 32*a* having smaller widths than the expanded portions 31*b* and 32*b*. The narrow portions 31*a* and 32*a* reduce discharge interference between the adjacent discharge cells to thus further enhance a stable discharge for each discharge cell 18, 28.

The sustain electrode 31 and the scan electrode 32 are arranged between non-discharge regions, i.e., the third barrier rib member 16*b* and the fourth barrier rib member 26*b*, and thus do not have a side effect that blocks visible light generated in the discharge cells 18, 28. Therefore, the sustain electrode 31 and the scan electrode 32 can be made of an opaque material, and/or made of a metal electrode having a good electrical conductivity.

Further, in the direction (e.g., in the z-axis direction) perpendicular to the rear substrate 10 and the front substrate 20, a height $t_3$ of the protrusion portions 11*a* and 12*a* of the first and second address electrodes 11 and 12 is formed smaller than a height $t_4$ of the sustain electrode 31 and a height $t_5$ of the scan electrode 32, so that the protrusion portions 11*a* and 12*a* of the first and second address electrodes 11 and 12 do not interrupt the sustain discharge, and the luminescence efficiency is further improved.

The sustain electrode 31 and the scan electrode 32 form an opposed discharge in the discharge cells 18, 28 that reduce the discharge firing voltage, and implement two reset operations in one reset in two discharge cells 18, 28 sharing the scan electrode 32. Since two addressing operations are also implemented in one scan as discussed above, the reset period and the addressing period can be reduced.

The sustain electrode 31, the scan electrode 32, and the first and second address electrodes 11 and 12 are formed with dielectric layers 34 and 35 on their outer surfaces. The dielectric layers 34 and 35 accumulate wall charges, but also form an insulating arrangement for each electrode. The sustain electrode 31, the scan electrode 32, and the first and the second address electrodes 11 and 12 can be manufactured in a thick film ceramic sheet (TFCS) method. In other words, after separately manufacturing an electrode portion including the sustain electrode 31, the scan electrode 32, and the first and second address electrodes 11 and 12, the electrode portion can be coupled to the rear substrate 10 on which the barrier rib 16 is formed.

An MgO protective layer 36 can be formed on surfaces of the dielectric layers 34 and 35 that cover the sustain electrode 31, the scan electrode 32, and the first and second address electrodes 11 and 12, respectively. In particular, the MgO protective layer 36 can be formed in a portion exposed to the plasma discharge generated in a discharge space within the discharge cell 18, 28. In the present embodiment, the sustain electrode 31, the scan electrode 32, and the first and second address electrodes 11 and 12 are arranged between two substrates 10 and 20 rather than formed directly on the front substrate 20 and the rear substrate 10, so that the MgO protective layer 36 deposited on the dielectric layers 34 and 35 covering the sustain electrode 31, the scan electrode 32, and the first and second address electrodes 11 and 12 may be made of MgO having visible light non-transmissive characteristics. The visible light non-transmissive MgO has a much higher secondary electron emission coefficient than the visible light transmissive MgO, and thus the discharge firing voltage can be further reduced.

Further, as described above and referring more specifically to FIG. 2, the sustain electrode 31 is arranged on either side of discharge cells 18, 28 sharing the scan electrode 32; the scan electrode 32 and the sustain electrode 31 are arranged between the third and fourth barrier rib members 16*b* and 26*b* corresponding thereto that form both sides of the discharge cells 18, 28 (both sides in the y-axis direction), respectively; and the first and second address electrodes 11 and 12 are arranged between the first and second barrier rib members 16*a* and 26*a* corresponding thereto that form both sides of the discharge cells 18, 28 (both sides in the x-axis direction). Thus, each of the protrusion portions 11*a* and 12*a* of the first and second address electrodes 11 and 12 is in one embodiment of the present invention formed to have a distance $d_1$ protruded inside the respective discharge cells 18, 28 that is larger than zero, i.e., $d_1>0$ such that two adjacent discharge cells 18, 28 can be selected with address pulses applied by the first and second address electrodes, respectively, and the scan pulse applied by the scan electrode 32.

Figure 5:
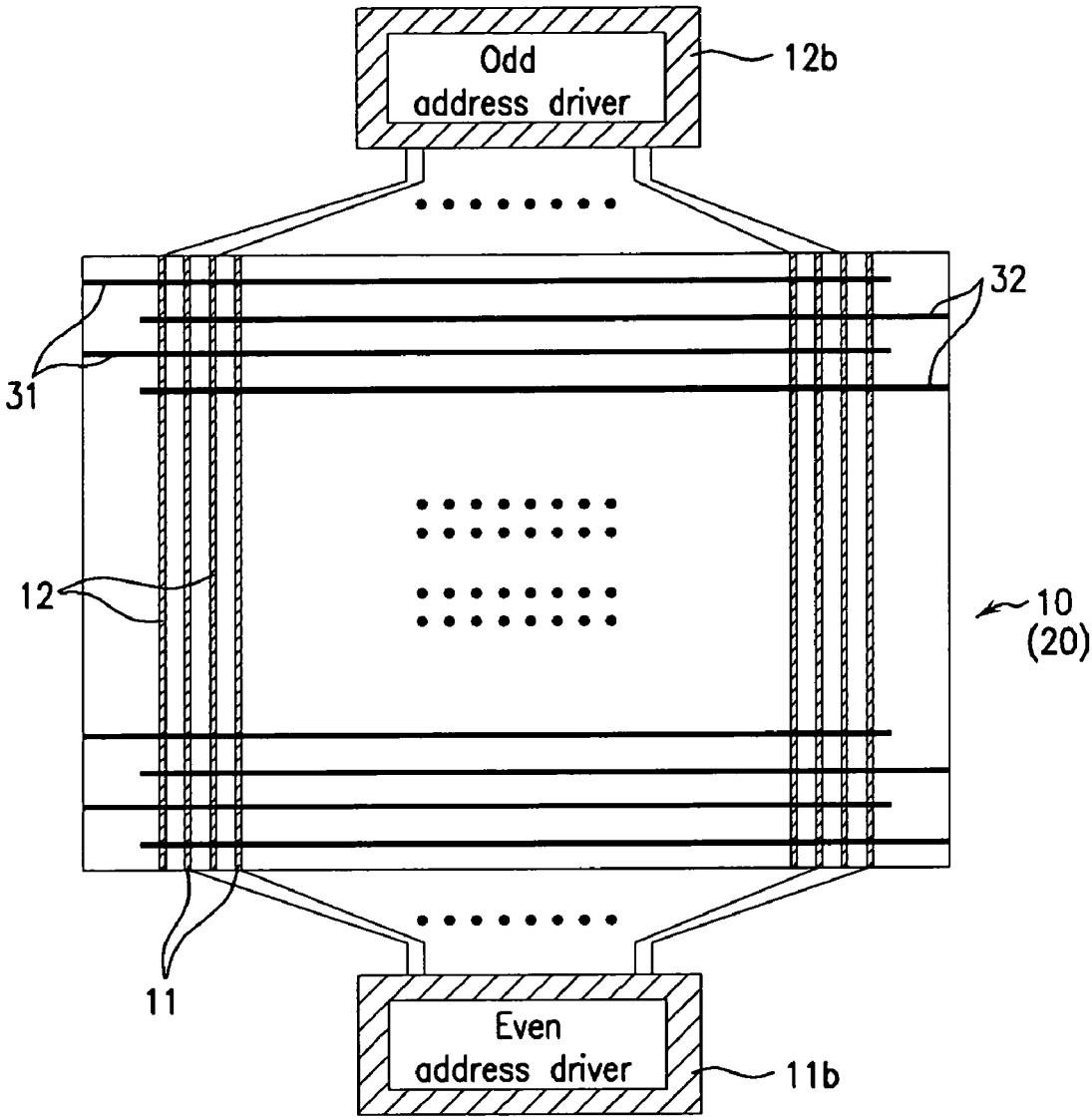
FIG. 5 is a schematic diagram showing a connection relation between the first and second address electrodes and respective drivers in the plasma display panel according to the first embodiment of the present invention.

In addition, the first and second address electrodes 11 and 12 are in one embodiment of the present invention formed to have a distance $d_2$ between the protrusion portions 11*a* and 12*a* and the scan electrode 32 that is larger than zero for opposing discharge with the scan electrode 32. As shown in FIG. 5, in one embodiment of the present invention, the first address electrode 11 is drawn out of one side of the substrates 10 and 20 and connected to a first (or even) address electrode driver 11*b*, and the second address electrode 12 is drawn out of the other side of the substrates 10 and 20 and connected to a second (or odd) address electrode driver 12*b*, and thus the adjacent discharge cells 18, 28 sharing the scan electrode 32 can be addressed twice by the first and second address electrode drivers 11*b* and 12*b* in one scan.

Figure 6:
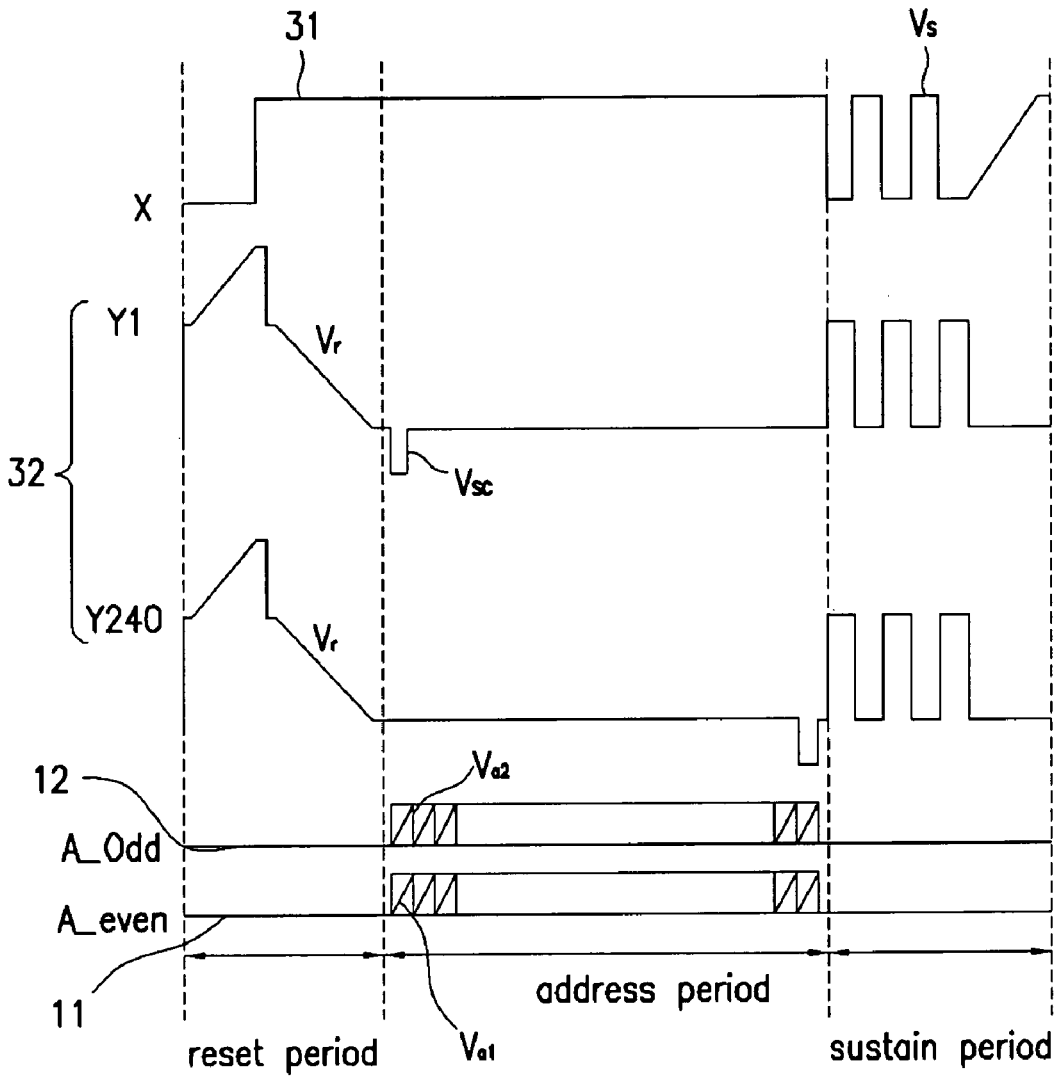
FIG. 6 is a driving waveform diagram of a method of driving a plasma display panel according to the first embodiment of the present invention.

A method of driving the PDP arranged as described above includes applying a scan pulse $V_{sc}$ to a scan electrode 32 shared by a first discharge cell 18, 28, and a second discharge cell 18, 28 adjacent to the first discharge cell 18, 28 during an addressing period; and addressing the first discharge cell 18, 28 and the second discharge cell 18, 28 to which the scan pulse is applied, as shown in FIG. 6.

The addressing process includes addressing the first discharge cell 18, 28 out of the two adjacent discharge cells 18, 28 with an address pulse $V_{a1}$ applied to the first address electrode 11, and addressing the second discharge cell 18, 28 with an address pulse $V_{a2}$ applied to the second address electrode 12. Therefore, in the above addressing process, the first and second discharge cells 18, 28 are addressed substantially at the same time.

In a reset process progressed prior to the above-mentioned scan and addressing processes, the reset process includes applying a reset pulse $V_r$ to a scan electrode 32 that interacts with a sustain electrode 31 arranged at either side of the scan electrode 32 to reset the two adjacent discharge cells 18, 28 at the same time. The reset pulse $V_r$ applied in the reset period may employ a waveform known to those skilled in the art, and the sustain pulse $V_s$ applied to the sustain period may employ a waveform known to those skilled in the art.

Figure 7:
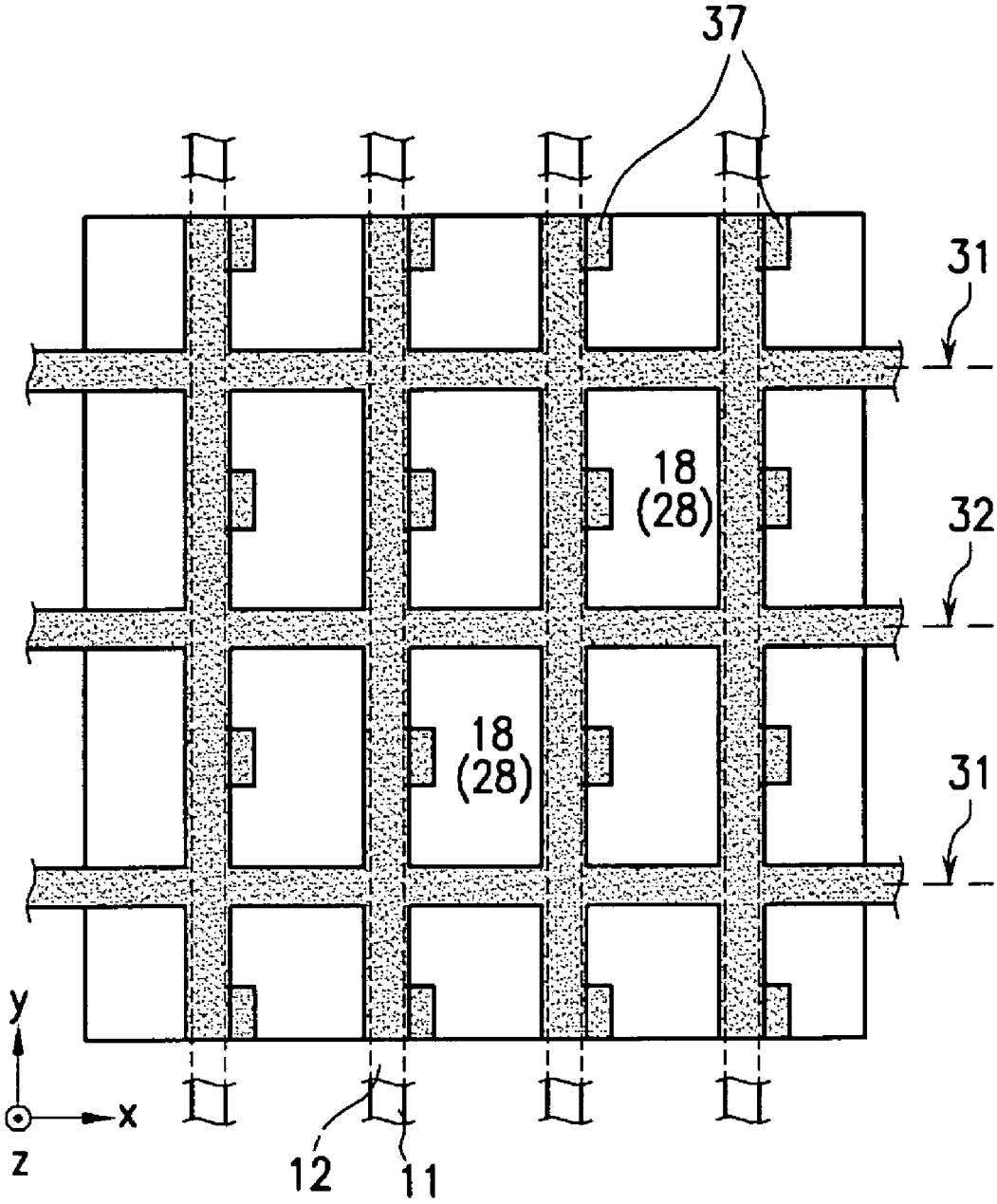
FIG. 7 is a partial plan view schematically showing a relationship between the discharge cell and a black layer in the plasma display panel according to the first embodiment of the present invention.

Further, in one embodiment of the present invention, a black layer 37 is formed on the front substrate 20 to improve a contrast, as shown in FIG. 7. The black layer 37 may be formed on the surface of the front substrate 20, and then covered with the second phosphor layer 29, as shown in FIG. 3. Alternatively, the black layer 37 may be formed on the second phosphor layer 29, after the phosphor layer 29 is formed on the front substrate 20 (not shown).

The black layer 37 in one embodiment of the present invention is formed in a shape corresponding to a plane (x-y plane) direction of the front substrate 20 of the first and second address electrodes 11 and 12, the sustain electrode 31, and the scan electrode 32. With this arrangement, the black layer 37 absorbs external light to improve the contrast, while it is arranged at a position where visible light is blocked with the above electrodes 11, 12, 31, and 32, so that any additional blocking component for blocking of visible light transmitted to the front substrate 20, other than the electrodes 11, 12, 31, and 32 having the black layer 37 for blocking the visible light, will not be required. Thus, the luminescence efficiency is further improved.

Certain other embodiments of the present invention will now be described. The following embodiments have substantially the same arrangements as to the above-mentioned embodiments. As such, these certain other embodiments will not be described in more detail below and only certain differences will be described below in more detail.

Figure 8:
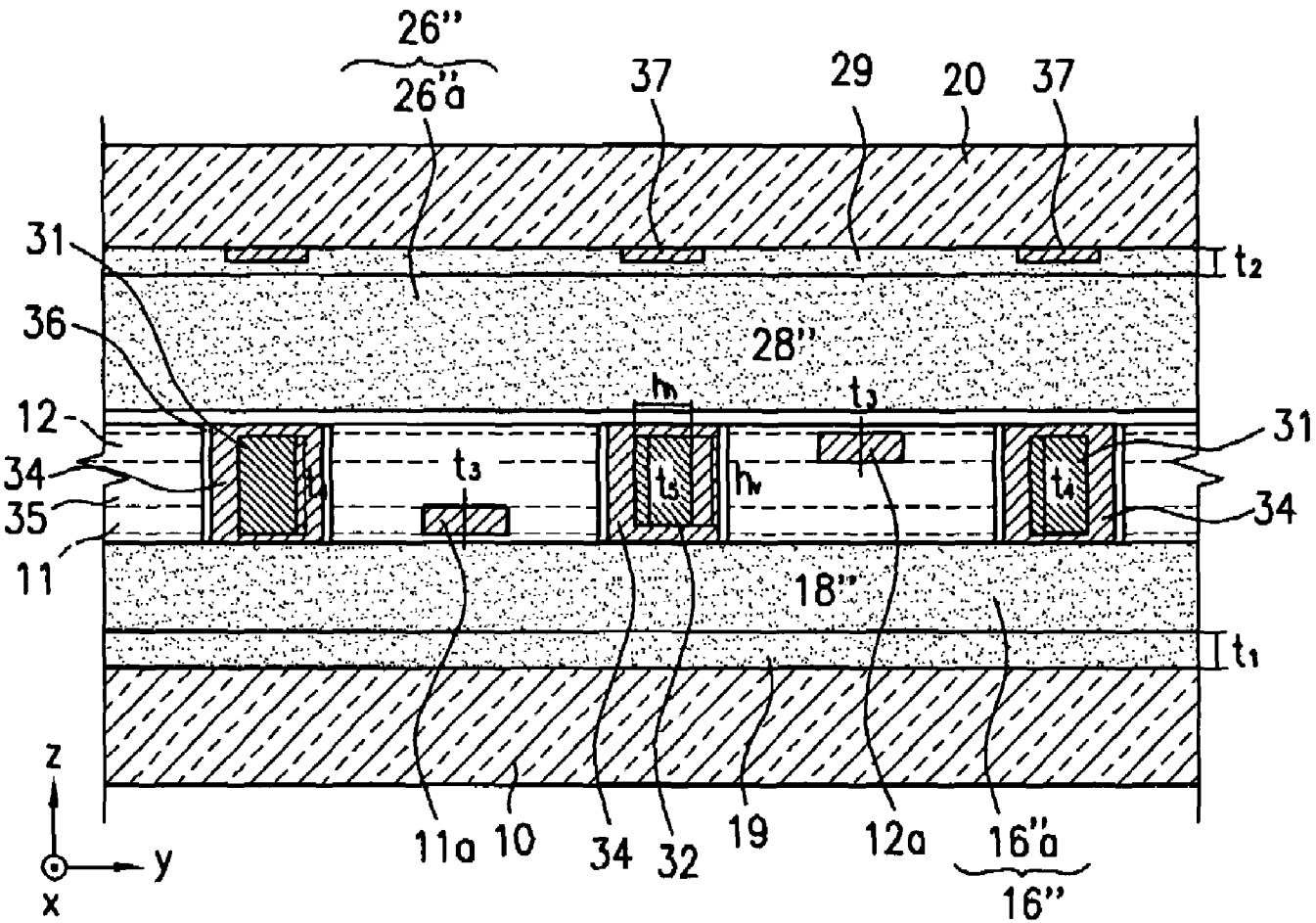
FIG. 8 is a partial cross-sectional view showing a plasma display panel according to a second embodiment of the present invention.

FIG. 8 shows a second embodiment of the present invention. According to the present embodiment, a rear plate barrier rib 16" includes a first barrier rib member 16"*a* formed in a direction parallel to first and second address electrodes 11 and 12, and a front plate barrier rib 26" includes a second barrier rib member 26"*a* formed in a direction parallel to the first and second address electrodes 11 and 12. Therefore, two discharge cells 18", 28" are formed in a stripe shape in which the discharge cells 18", 28" are successively linked in an extending direction (e.g., in a y-axis direction) of the first and second address electrodes 11 and 12.

Figure 9:
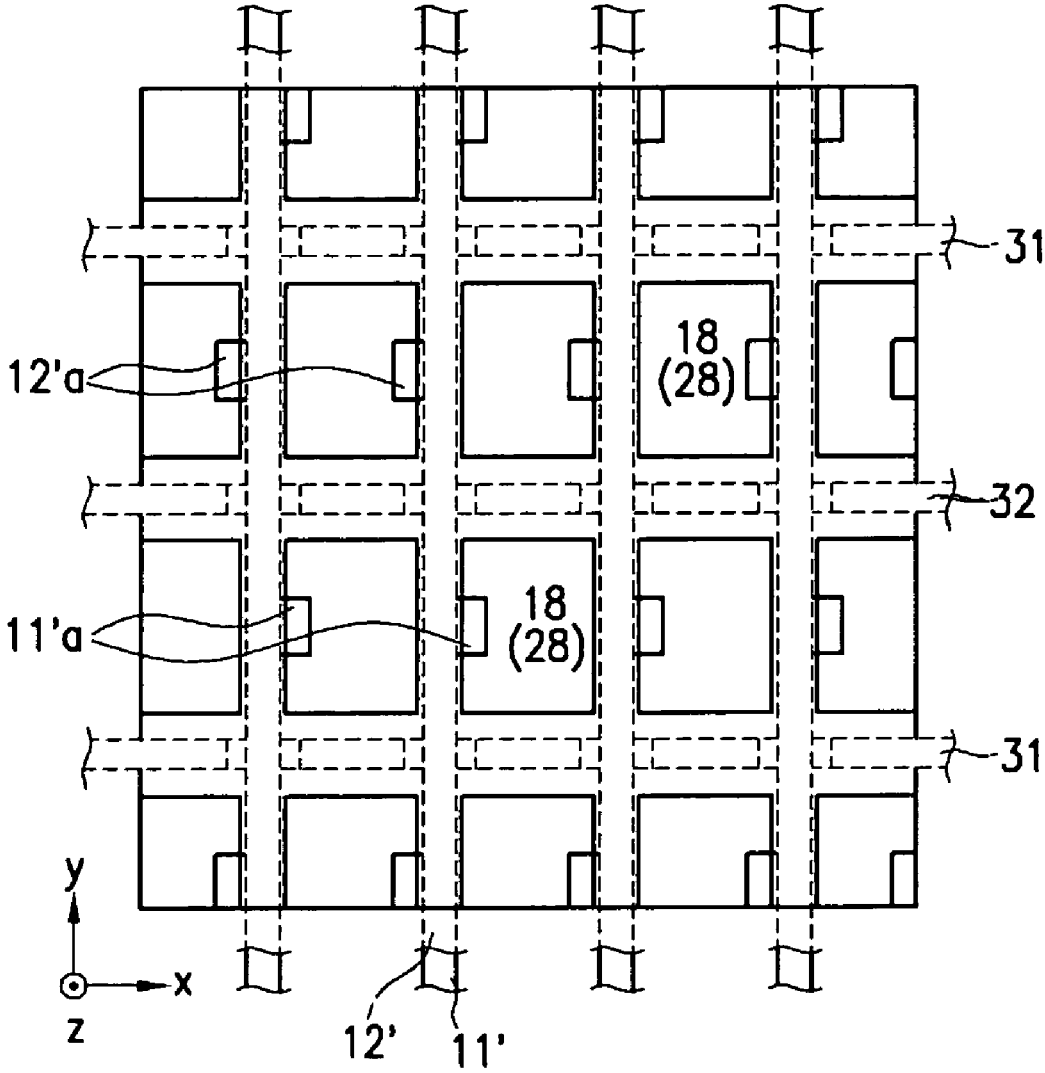
FIG. 9 is a partial plan view schematically showing an arrangement of electrodes and discharge cells in a plasma display panel according to a third embodiment of the present invention.

FIG. 9 is a plan view showing a plasma display panel according to a third embodiment of the present invention. The present embodiment has another parallel arrangement of first and second address electrodes 11' and 12'.

In the third embodiment of the present invention, the first address electrode 11' and the second address electrode 12' are formed at both sides of discharge cells 18, 28, respectively. In this embodiment, each of the first address electrode 11' and the second address electrode 12' blocks interruption of protrusion portions 11'*a* and 12'*a* into the discharge cells 18, 28 from each other, and can be formed in a position separated from a rear substrate 10 by a same or different distance as the embodiment of FIG. 3.

The first address electrode 11' and the second address electrode 12' are arranged at both sides in the x-axis direction of the discharge cells 18, 28, so that the respective protrusion portion 11'*a*, 12'*a* are alternately protruded toward the respective center of the successively arranged discharge cells 18, 28. In this embodiment, the protrusion portion 11'*a* of the first address electrode 11' and the protrusion portion 12'*a* of the second address electrode 12' are protruded toward the center of the respective discharge cells 18, 28 (e.g., in the x-axis direction) at different sides of the discharge cells 18, 28.

As described above, according to a plasma display panel of the present invention, electrodes are arranged between a rear substrate and a front substrate, and among these electrodes, a sustain electrode is arranged on one side of a discharge cell while a scan electrode is arranged on one side of another discharge cell, in an opposed discharge structure. Here, the sustain electrode and the scan electrode are alternately arranged and shared by the adjacent discharge cells. Further, first and second address electrodes are arranged for addressing discharge cells of an odd-numbered group and discharge cells of an even-numbered group, respectively, so that the opposed discharge of the sustain electrode and the scan electrode lowers a discharge firing voltage. Further, since the scan electrode is shared in the adjacent discharge cells to reset the discharge cells of the odd-numbered group and the discharge cells of the even-numbered group at the same time, a reset period is reduced, and in addition, since the first address electrode and the second address electrode address the discharge cells of the odd-numbered group and the discharge cells of the even-numbered group at the same time, an addressing period can also be reduced. The reduction of the reset period and the addressing period extends the sustain period, thus improving a gray level representation.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel comprising:

a first substrate and a second substrate facing each other with a first space therebetween and having a plurality of discharge cells defined in the first space between the first and second substrates;

a plurality of phosphor layers formed inside the respective discharge cells;

first and second display electrodes extending along a first direction and between the first and second substrates, the respective first and second display electrodes facing each other with a second space therebetween to expand in a third direction from the first substrate to the second substrate; and first and second address electrodes extending along a second direction intersecting the first direction, between the first and second substrates, and separated from each other in the third direction, wherein the first and second address electrodes comprise first and second protrusion portions alternately protruded toward the center of the respective discharge cells successively arranged along the second direction.

2. The plasma display panel of claim 1, further comprising:

a first barrier rib layer on the first substrate defining a plurality of first discharge spaces; and a second barrier rib layer on the second substrate defining a plurality of second discharge spaces facing the respective first discharge spaces defined by the first barrier rib layer;

wherein opposing pairs of the first and second discharge spaces define the respective discharge cells.

3. The plasma display panel of claim 2, wherein the first and second display electrodes and the first and second address electrodes are between the first and second barrier rib layers.

4. The plasma display panel of claim 2, wherein a volume of at least one of the second discharge spaces defined by the second barrier rib layer is larger than a volume of a corresponding one of the first discharge spaces defined by the first barrier rib layer.

5. The plasma display panel of claim 2, wherein the first barrier rib layer comprises a first barrier rib member extending in the first direction; and the second barrier rib layer comprises a second barrier rib member extending in the first direction.

6. The plasma display panel of claim 5, wherein the first barrier rib layer further comprises a third barrier rib member intersecting the first barrier rib member; and the second barrier rib layer further comprises a fourth barrier rib member intersecting the second barrier rib member.

7. The plasma display panel of claim 5, the first and second address electrodes are extending along the first barrier rib member between the first barrier rib member of the first barrier rib layer and the second barrier rib member of the second barrier rib layer.

8. The plasma display panel of claim 1, wherein the first and second address electrodes pass through a boundary of a pair of adjacent ones of the discharge cells in the first direction.

9. The plasma display panel of claim 1, wherein the first address electrode is closer to the first substrate than to the second substrate, and the second address electrode is closer to the second substrate than to the first substrate, and wherein the first and second display electrodes are between the first and second address electrodes.

10. The plasma display panel of claim 1, wherein the first and second address electrodes, corresponding to a pair of the discharge cells arranged to be adjacent along the second direction, are arranged together on a same side of the pair of the discharge cells.

11. The plasma display panel of claim 1, wherein the first and second address electrodes, corresponding to a pair of the discharge cells arranged to be adjacent along the second direction, are arranged on different sides of the pair of the discharge cells, respectively.

12. The plasma display panel of claim 1, wherein the first and second address electrodes are each made of a metal electrode.

13. The plasma display panel of claim 1, wherein each of the first and second display electrodes comprises:

an expanded portion corresponding to one of the discharge cells and extending in the third direction; and a narrow portion corresponding to boundaries of the discharge cells successively arranged along the first direction and having a smaller width than the expanded portion.

14. The plasma display panel of claim 13, wherein the expanded portion of the first display electrode and the expanded portion of the second display electrode are symmetric with respect to a centerline of the narrow portion extending in the first direction.

15. The plasma display panel of claim 1, wherein the first and second display electrodes are each made of a metal electrode.

16. The plasma display panel of claim 1, wherein the first and second display electrodes and the first and second address electrodes include dielectric layers on their outer surfaces, respectively.

17. The plasma display panel of claim 16, wherein each of the dielectric layers comprises a protective layer on its outer surface.

18. A method of driving a plasma display panel comprising: first and second display electrodes extending along a first direction between a first substrate and a second substrate, which face each other, and alternately arranged while sharing adjacent discharge cells along a second direction that intersects the first direction; and first and second address electrodes extending along the second direction and separated in a third direction from the first substrate to the second substrate, the method comprising:

applying a scan pulse to a corresponding one of the second display electrodes shared by first and second discharge cells of the discharge cells adjacent along the second direction, during an addressing period; and addressing the first and second discharge cells to which the scan pulse is applied, wherein the first and second address electrodes comprise first and second protrusion portions alternately protruded toward the center of the respective discharge cells successively arranged along the second direction.

19. The method of driving a plasma display panel of claim 17, wherein in the addressing of the first and second discharge cells comprises addressing the first and second discharge cells substantially simultaneously.

20. The method of driving a plasma display panel of claim 17, wherein the addressing of the first and second discharge cells comprises addressing the first discharge cell by the first address electrode.

21. The method of driving a plasma display panel of claim 18, wherein the addressing of the first and second discharge cells comprises addressing the second discharge cell by the second address electrode.

22. The method of driving a plasma display panel of claim 17, wherein the addressing of the first and second discharge cells comprises addressing the first discharge cell by the first address electrode and addressing the second discharge cell by the second address electrode.

* * * * *